United States Patent [19]

Hornagold et al.

[11] Patent Number: 4,690,246

[45] Date of Patent: Sep. 1, 1987

[54] ARTICULATED WORK PLATFORM WITH SCISSORS MOTION

[75] Inventors: John T. Hornagold, Delafield; Paul Pezewski, Milwaukee, both of Wis.

[73] Assignee: Simon Aerials, Inc., Milwaukee, Wis.

[21] Appl. No.: 754,024

[22] Filed: Jul. 11, 1985

[51] Int. Cl.[4] ..... B66F 11/04

[52] U.S. Cl. ..... 182/2; 182/19; 182/131; 182/2

[58] Field of Search ..... 182/2, 18, 19, 131, 182/63, 187

[56] References Cited

U.S. PATENT DOCUMENTS

| | | | |
|---|---|---|---|
| 1,348,683 | 8/1920 | Aldenbruck | 182/129 |
| 1,440,904 | 1/1923 | Bethke | 182/129 |
| 2,614,893 | 10/1952 | Merrill | 182/131 |
| 2,701,168 | 2/1955 | Schemers | 182/129 |
| 2,979,152 | 4/1961 | Eitel | 182/2 |
| 2,996,140 | 8/1961 | Troche | 182/2 |
| 3,085,650 | 4/1963 | Merk | 182/131 |
| 3,301,348 | 1/1967 | Hiyama | 182/131 |
| 3,393,768 | 7/1968 | Miller | 182/63 |
| 3,670,849 | 6/1972 | Milner | 182/2 |
| 4,074,819 | 2/1978 | Labourre | 182/131 |
| 4,331,215 | 5/1982 | Grove | 182/2 |

*Primary Examiner*—Reinaldo P. Machado

*Attorney, Agent, or Firm*—Andrus, Sceales, Starke & Sawall

[57] ABSTRACT

An improved work platform suitable for mounting on a vehicle mounted telescoping boom. The work platform includes a fixed platform section mounted on the tip of the boom in conjunction with a leveling mechanism. Two movable side platform sections are pivotally fastened at one of their ends to the fixed platform section for independent movement on either side of a centerline. The side platform sections may be moved apart in a scissors-like motion so that the platform may be maneuvered to straddle the object being worked on. Bumpers and troughs are provided along the inner edge of the side platform sections to protect the object being worked on and to prevent articles from rolling off the platform. When the side panel sections are moved into abutment to use the platform as a conventional unitary platform, a hinged flap on one of the side platform sections covers the abutting edges of the side platform sections, the bumpers and the troughs. A pin on one side platform section is extendable to engage a loop on the other side platform section to prevent differential deflection of the outer ends of the side platform sections. A proximity sensor is provided to prevent the work platform from striking and damaging the object being worked on.

22 Claims, 10 Drawing Figures

ARTICULATED WORK PLATFORM WITH SCISSORS MOTION

BACKGROUND AND SUMMARY OF THE INVENTION

The present invention relates to a work platform with pivoting sections that may be articulated in a scissors-like motion to partially or totally surround the object being worked on. The platform may be fastened at the tip of a vehicle mounted boom for movement to and from the object. While not limited thereto, the present invention is highly useful in servicing the vertical stabilizers and rudders of aircraft.

The vertical stabilizer of an aircraft presents difficulty in servicing because of its height. Currently, platforms elevated by scissors mechanisms may be employed. However, these usually require outriggers to obtain the necessary stability.

Platforms on vehicle mounted booms may also be utilized. The boom pivots in a vertical plane. Typically one platform is placed on each side of the vertical stabilizer. However, this requires two machines and presents problems in the transfer of personnel and equipment from one side of the stabilizer to another.

The object of the present invention is, therefore, to provide an improved work platform suitable for mounting on a vehicle boom. The work platform is mounted at one of its ends to extend from the boom, which may be telescoping, articulated, fixed length or any other construction. This provides an unobstructed area beneath the boom that facilitates its use.

The work platform includes two movable side platform sections pivotally fastened at one of their ends to a knuckle member at the tip of the boom. The side platform sections may be moved apart in a scissors-like motion so that the platform may be maneuvered to straddle the object being worked on, such as the vertical stabilizer of an aircraft. The side platform sections may also pivot or swing beyond the centerline between the two side sections to allow for angular misalignment of the boom with respect to the desired work area. The work platform may also include a fixed platform section mounted above the side platform sections on the tip of the boom. A master-slave hydraulic cylinder leveling mechanism maintains the work platform level throughout the range of angular movement of the boom.

Bumpers are provided along the inner edge of the side platform sections to protect the object being worked on. Troughs may also be provided along the inner edges to catch small parts, tools, fasteners, and the like that otherwise might tend to roll or fall off the platform and damage equipment down below or cause injury to personnel.

If desired, the side platform sections may be moved into abutment so that the platform may be used as a unitary platform in a more conventional manner. A hinged flap on one of the side platform sections covers the abutting edges of the side platform sections, the bumpers, and the troughs. A pin on one side platform section extends to engage a loop on the other side platform section to prevent differential deflection of the outer ends of the side platform sections.

A proximity sensor is provided to prevent the work platform from striking and damaging the object being worked on. The proximity sensor may comprise one or more hoops suspended on chains below the work platform. Sensors, such as limit switches, coact with the sensor hoops to stop movement of the platform before it strikes the object being worked on.

BRIEF DESCRIPTION OF THE DRAWINGS

The invention will be further explained in the following detailed description with the aid of the drawings in which.

DESCRIPTION OF THE PREFERRED EMBODIMENTS

Figure 1:
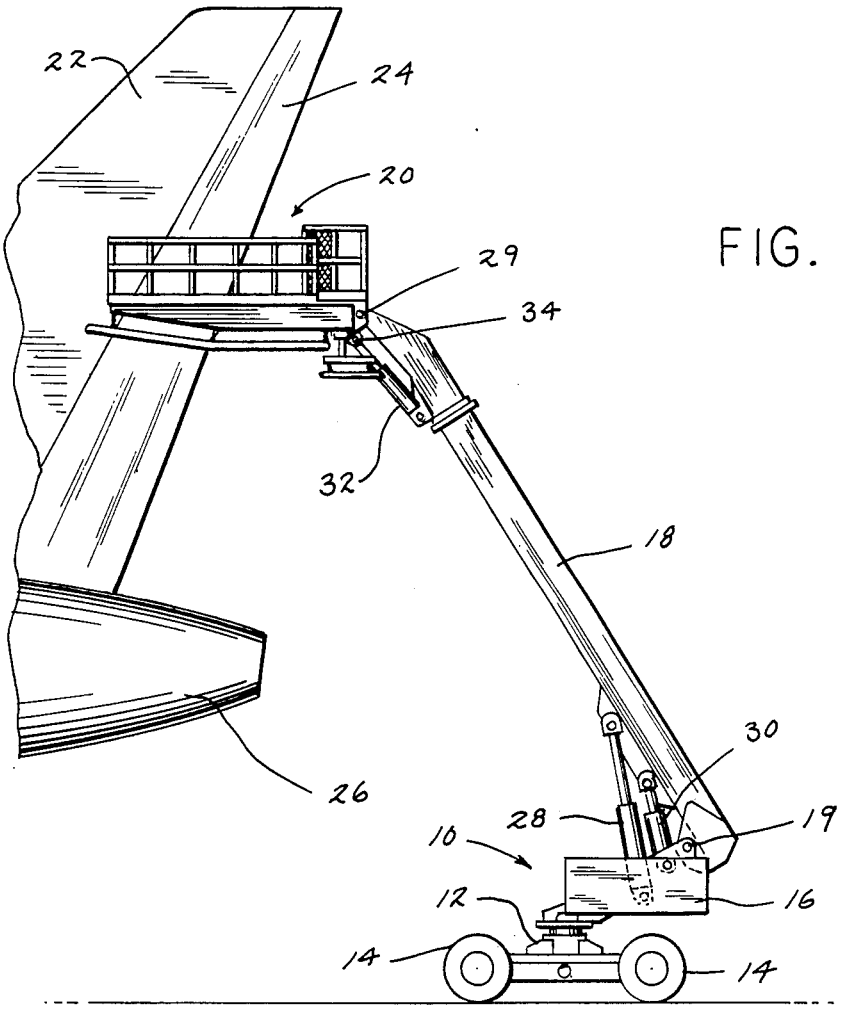
FIG. 1 is a side view of the work platform of the present invention shown in conjunction with a boom on a vehicle and the aft portions of an aircraft.

Vehicle 10 includes undercarriage 12 having wheels 14 for moving the vehicle around a work area. Superstructure 16 is mounted on undercarriage 12 to rotate in a horizontal plane. One end of extendable boom 18 is mounted to superstructure 16 to pivot in a vertical plane about pivot pin 19. Work platform 20 is mounted to the other end of boom 18 for positioning workers to service an object, such as vertical stabilizer 22 and rudder 24 of aircraft 26.

Superstructure 16 contains the prime mover for the vehicle, and powers a hydraulic system including a hydraulic motor and actuator for driving and steering wheels 14. The prime mover may be any type of power source, such as a gasoline or diesel engine, and the prime mover may be located anywhere on the vehicle including superstructure 16 as well as boom 18. Boom 18 is extendable and retractable by means of a, not shown, hydraulic cylinder within boom 18. Boom 18 is raised and lowered by means of hydraulic cylinder 28.

Figure 2:
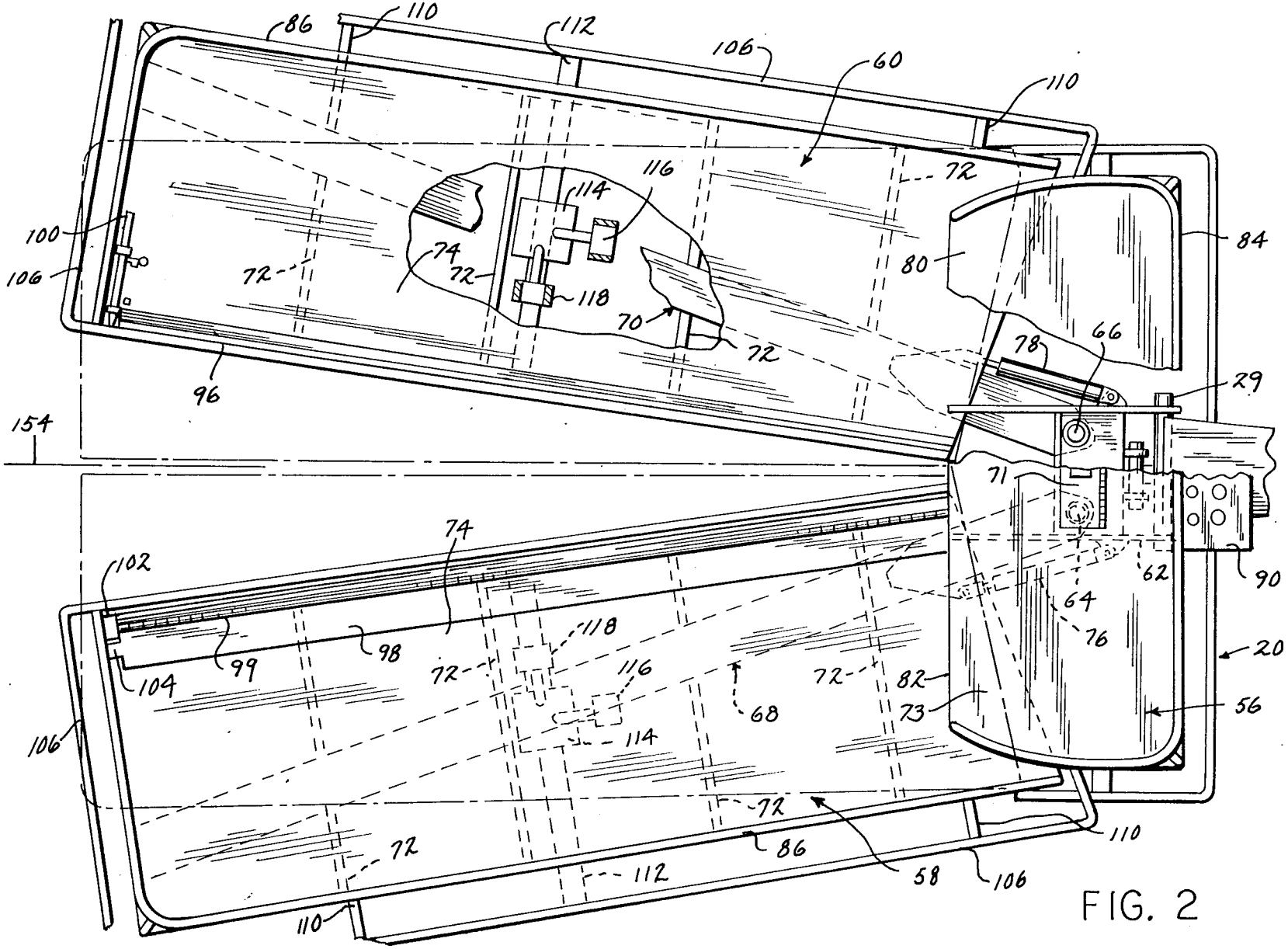
FIG. 2 is a top view of the work platform showing the side platform sections in their spread apart position in solid lines and in their closed position in phantom.
Figures 3, 4, 5:
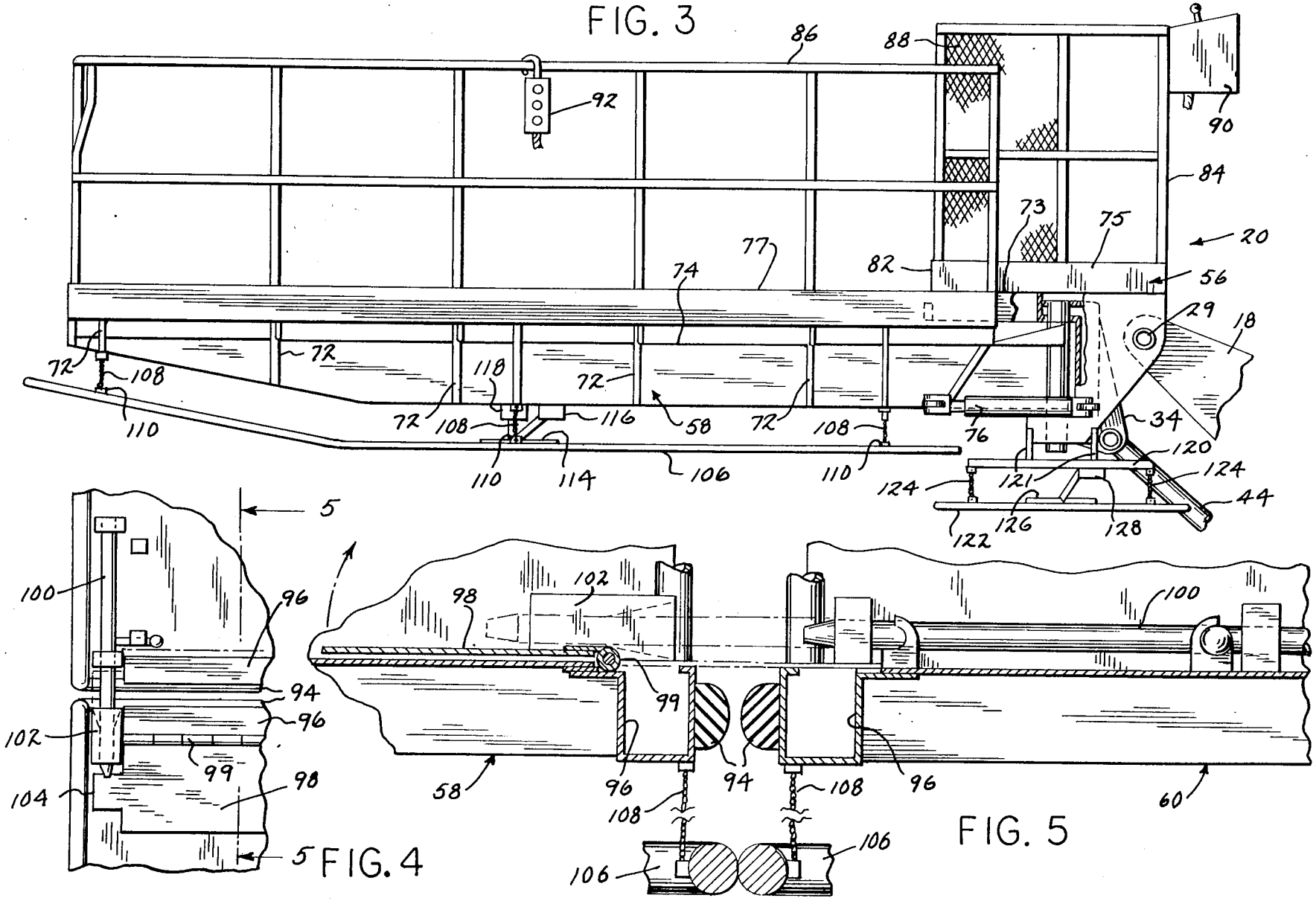
FIG. 3 is a side view of the work platform in the closed position.
FIG. 4 is a fragmentary top view of the work platform of the present invention showing additional details thereof.
FIG. 5 is a cross sectional view along the line 5—5 of FIG. 4.
Figure 7:
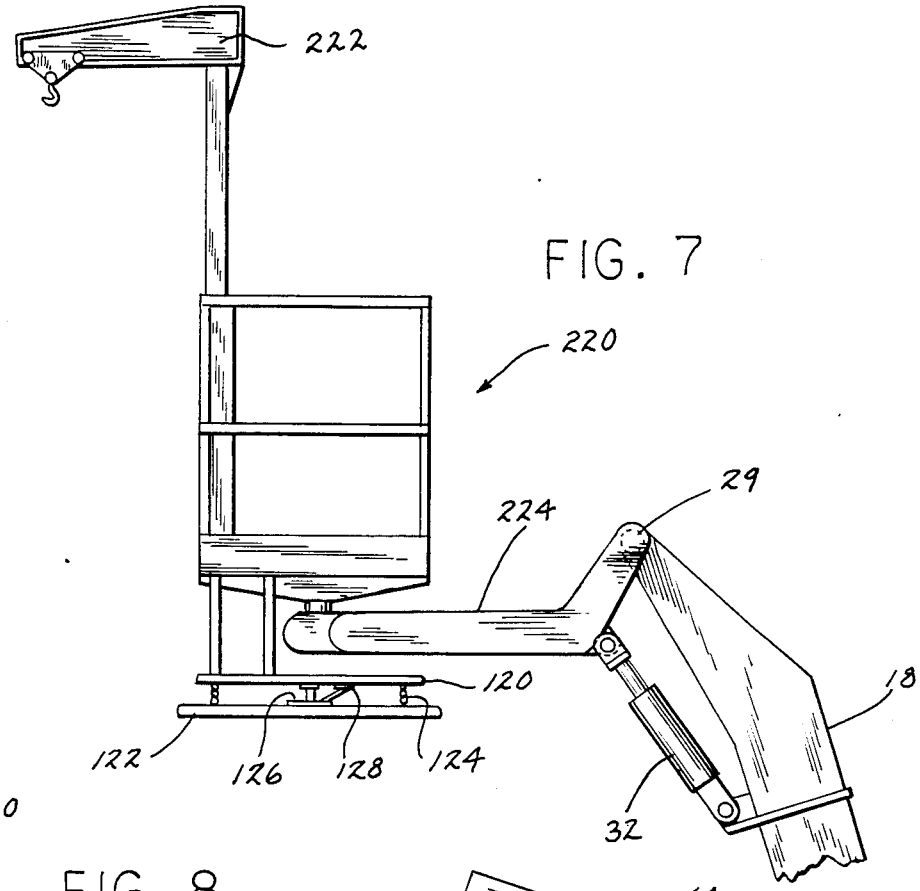
FIG. 7 shows a modification illustrating the interchangeable use of the work platform with a smaller basket as the fixed platform section.

Work platform 20 is pivotally mounted, at one end to the tip of boom 18 by pivot pin 29, as shown in FIGS. 1, 2, and 3. The end mounting of work platform 20 contrasts to the conventional center mounting in which the boom is fastened to the center of the bottom of the platform. The end mounting of the work platform 20 to the boom tip provides an unobstructed area below platform 20 that is highly desirable in applications, such as aircraft servicing.

Figure 6:
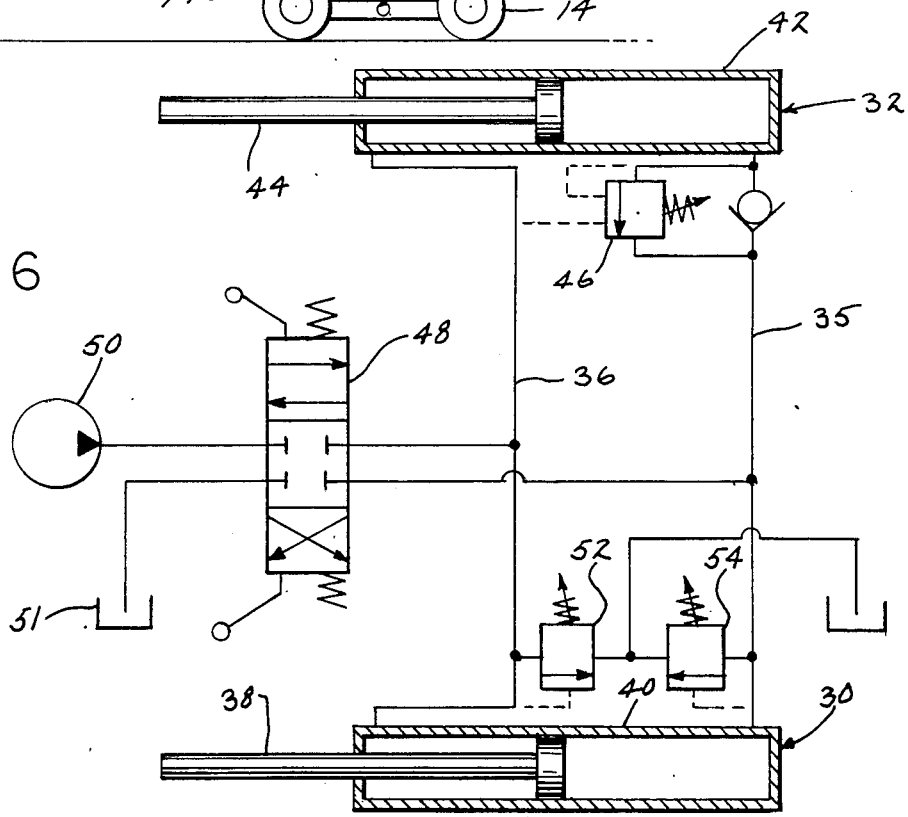
FIG. 6 is a schematic diagram of a hydraulic leveling circuit for use in conjunction with the work platform of the present invention.

Work platform 20 is kept level as boom 18 is raised and lowered by the master-slave hydraulic cylinder arrangement shown in FIGS. 1 and 6. Specifically, master hydraulic cylinder 30 is mounted between boom 18 and superstructure 16 so as to be driven by boom 18 as the boom pivots on superstructure 16. Slave cylinder 32 is mounted on the underside of boom 18 between the boom and arm 34 of work platform 20 extending below the pivot pin 29. As shown in FIG. 6, hydraulic cylinders 30 and 32 are connected in parallel by hydraulic lines 35 and 36. These hydraulic lines extend along boom 18.

In operation, as boom 18 is raised or pivoted about pin 19, work platform 20 must be rotated or pivoted counterclockwise about pin 29 relative thereto to remain level. As boom 18 is raised, cylinder rod 38 is extended from cylinder body 40 of master cylinder 30. This forces hydraulic fluid out of master cylinder 30 through hydraulic line 36 into slave cylinder 32. Hydraulic fluid is correspondingly transferred through line 35 into master cylinder 30. The hydraulic fluid supply causes cylinder rod 44 of slave cylinder 32 to retract in cylinder body 42. Cylinder rod 44 is fastened to arm 34 of work platform 20 and its retraction produces the desired relative counterclockwise movement of work platform 20 about pin 29.

The operation is reversed when boom 18 is lowered to produce a relative clockwise rotation of work platform 20 with respect to boom 18.

Pilot operated safety valve 46 insures that work platform 20 does not suddenly tip downwardly in the event of the loss of hydraulic pressure. Operator controlled valve 48 permits hydraulic fluid to be added from pump 50 and removed to sump 51 to correct for the loss of synchronization between the slave and master hydraulic cylinders. Master hydraulic cylinder 30 is provided with pressure relief valves 52 and 54.

It may be noted that master hydraulic cylinder 30 is connected in parallel with the boom raiselower hydraulic cylinder 28. Hydraulic cylinder 30 assists hydraulic cylinder 28 in resisting downwardly applied forces due to the weight of platform 20 inducing pressure in slave cylinder 32 which pressure in turn is applied to or "felt" by master cylinder 30. Thus the size of hydraulic cylinder 28 may be reduced, with the attendant economy in the construction of vehicle 10.

Figure 8:
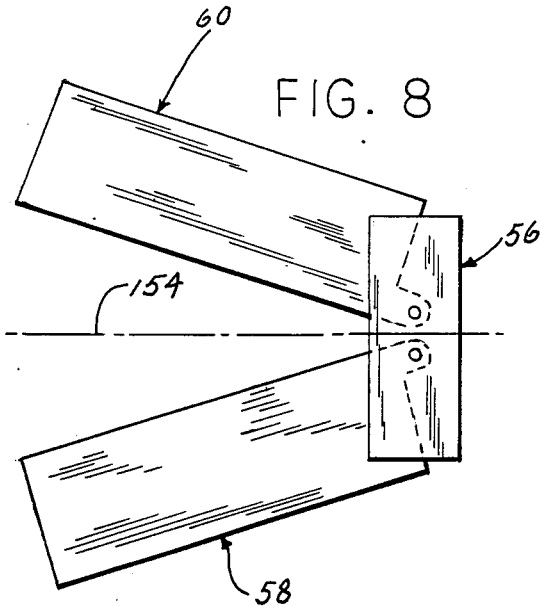
FIG. 8 is a schematic plan view illustrating the side platform sections in their fully opened positions.
Figure 9:
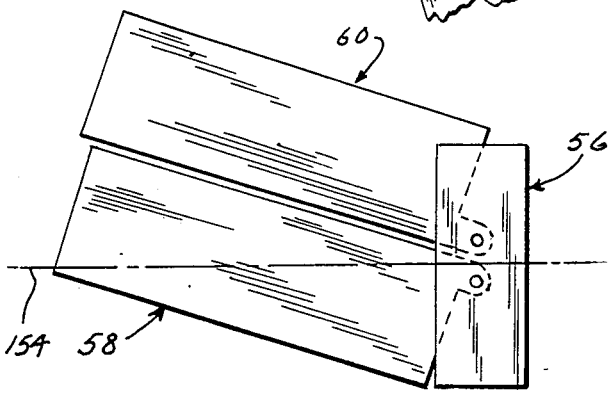
FIG. 9 is a schematic plan view illustrating the side platform sections in a skewed position.

As shown most clearly in FIG. 2, work platform 20 includes fixed platform section 56. Two side platform sections 58 and 60 are pivotally mounted at their ends to fixed platform section 56. By spreading side platform section 58 and 60 apart in a generally scissors like motion, as shown in FIG. 2, they may be moved along either side of an object, such as the vertical stabilizer of an aircraft to service the stabilizer or rudder. Each side platform section may typically move or pivot up to a total of about 30° i.e. 15° in either direction from the center line 154 of work platform 20. The side platform sections may move independently. Thus, sections 58 and 60 may be moved from an abutting position, as shown in phantom lines in FIGS. 2 and 8, in opposite directions to a spread apart position, as shown in solid lines in FIG. 2, where they form an angle of about 30° therebetween. Also, if either section 58 or section 60 is moved into its solid line position as shown in FIG. 2, the other section may be moved in the same direction into abutment therewith to form a platform that is skewed with respect to boom 18, as shown in FIG. 9. This latter position compensates for any angular misalignment of boom 18 with respect to the desired work area. Fixed platform section 56 common to both side platform sections 58 and 60 permits workers and equipment to move from one side of the stabilizer to the other.

Figure 10:
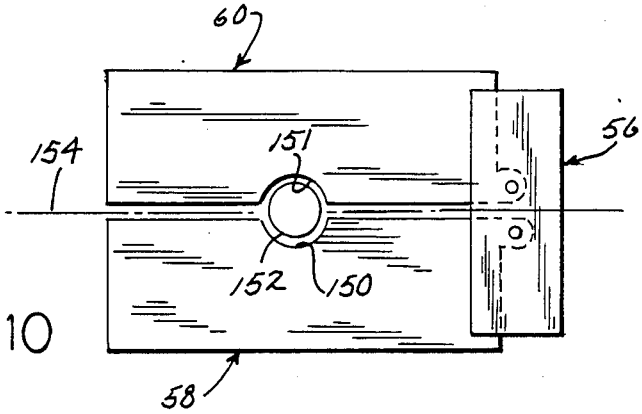
FIG. 10 is a schematic plan view showing another modification illustrating the side platform sections surrounding a telephone pole.

As shown best in FIG. 10, the inner edges of side platform sections 58 and 60 may be shaped to conform to the shape of the object to be worked on. For example, FIG. 10 illustrates sections 58 and 60 as including respective semi-circular openings 150 and 151 which conform to the shape of a telephone pole 152. Sections 58 and 60 may thus be opened, moved into position about pole 152, and then closed to surround pole 152 to provide a platform that encircles the desired work area. As noted above, the inner edges of sections 58 and 60 may incorporate any desired shape.

As shown in FIG. 3, fixed platform section 56 is mounted on top of knuckle member 62 mounted to the tip of boom 18 by pivot pin 29. Knuckle member 62 contains arm 34 connected to cylinder rod 44 of slave leveling hydraulic cylinder 32. Knuckle member 62 journals pivot pins 64 and 66 for beams 68 and 70, respectively, of side platform sections 58 and 60. An access hatch 71 in the floor 73 of fixed platform section 56 permits servicing of pivot pins 64 and 66. A plurality of braces or ribs 72 extend from beams 68 and 70 to support the floors 74 of the side platform sections. Kick plate 75 surrounds floor 73 on fixed platform section 56 and kick plate 77 surrounds portions of the floor 74 of side platform sections 58 and 60.

Side platform sections 58 and 60 are swung toward and away from each other by hydraulic cylinders 76 and 78 mounted between knuckle member 62 and beams 68 and 70 of side platforms 58 and 60, respectively. Side platform sections 58 and 60 pivot beneath fixed platform section 56, as shown in FIG. 2. The floor 73 of fixed platform section 56 is sufficiently above the floor 74 of the side platform sections to provide a well defined step 82 that can be marked to avoid tripping by workmen.

Rail 84 surrounds three sides of fixed platform section 56, as shown best in FIG. 2. Rails 86 lie along the outer sides and ends of side platform section 58 and 60. Rails 84 and 86 are formed so that sufficient clearance exists between the rails at all positions of side platform sections 58 and 60 to avoid pinching worker's hands. Mesh 88 is provided in rails 84 to avoid possible injury to the lower portions of the worker's body when side platform sections 58 and 60 are moved.

A control station 90 is provided on fixed platform section 56 for operating the hydraulic system of service vehicle 10 and work platform 20. A pendant controller 92 may also be provided.

As shown most clearly in FIGS. 4 and 5, the inner edges of side platform sections 58 and 60 have soft bumpers or cushions 94 that protect the object being worked on from damage. Also, the inner edges each have a trough 96 that catches small tools, fasteners, parts, et. that might tend to roll or fall off the side platform sections and damage or injure objects or personnel below.

On occasion, it may be desirable to utilize work platform 20 as a unitary platform in a more conventional manner. To this end, side platform sections 58 and 60 are moved into abutment. Flap 98 is swung over bumpers 94 and troughs 96, as shown in FIG. 5, to cover them. Flap 98 is hinged on side platform section 58, as by a piano hinge 99. Pin 100 on the end of one side platform section is moved through loop 102 on the other side platform section so that a differential deflection is limited between the two platform side sections. A tang 104 on the end of flap 98 lies below pin 100 when inserted in loop 102 to lock the flap in the covering position.

To prevent the operator from inadvertantly damaging the object being worked on when moving work platform 20 or service vehicle 10, a proximity sensor is provided beneath work platform 20. As shown in FIG. 3, the proximity sensor may comprise a bar formed in a hoop 106 suspended by chains 108 below each side platform section 58 and 60. As shown generally in FIG. 2, hoop 106 is generally rectangular extending beyond the edges of the side platform sections, except along the inner edges of the side platform sections. Along their inner edges, each hoop 106 lies generally directly below the associated inner edges of side platform sections 58 and 60. Members 110 extend across the hoops. Chains 108 are fastened to members 110. Member 112 extends across the center of hoop 106 to centrally position plate 114 beneath each side platform section 58 and 60. Two limit switches 116 and 118, oriented at 90° to each other, are mounted on the bottom of the side platform sections to engage plate 114.

Should hoop 106 strike an object, as service vehicle 10 or work platform 20 are being manuevered, plate 114 will raise as the hoop suspended on chains 108 moves. This will activate one or both of the limit switches, deenergizing the hydraulic system to prevent any damage that might occur were the movement of work platform 20 or service vehicle 10 to continue. The 90° orientation of the two limit switches insures operation of the proximity sensor in a wide variety of movements of service vehicle 10, boom 18, and side platform section 58 and 60. Although described herein as employing two limit switches, one limit switch could also be used alone along with a different actuator means if desired.

A similar proximity detector is mounted below fixed platform section 56. To insure clearance with boom 18 and slave cylinder 32, frame 120 is mounted below knuckle member 62 by rods 121. Hoop 122 is suspended on chains 124 from frame 120. A plate 126 is mounted across hoop 122 to engage limit switch 128 mounted on frame 120.

Work platform 20 is designed to be interchangeable by utilizing quick disconnect couplings on hydraulic hoses and electrical cables so that it can be removed and small work platform 220 with jib crane 222 fitted to the tip of boom 18 for making lifts in connection with work on the object. Work platform 220 includes generally L-shaped arm 224, one end of which is pivotally mounted on the tip of boom 18 by pivot pin 29. Slave leveling hydraulic cylinder 32 is mounted at the bend of generally L-shaped arm 224. The other end of arm 224 is pivotally mounted to work platform 220 in the central portions of the floor. The mounting for work platform 220 includes means for rotating the work platform in a horizontal plane. Jib 222 is mounted on work platform 220. A proximity sensor 120–128, generally corresponding to that shown in FIG. 3 is mounted beneath work platform 220.

Various modes of carrying out the invention are contemplated as being within the scope of the following claims particularly pointing out and distinctly claiming the subject matter which is regarded as the invention.

We claim:

1. A work platform suitable for mounting on a base, comprising:

a pair of side platform sections each having one end adjacent said base and its other end extending from said base, said side platform sections being movable toward and away from each other between a first position in which said side platform sections are adjacent one another and a second position in which said side platform sections diverge in a direction away from said one ends;

pivotal mounting means for pivotally mounting said one ends of said side platform sections to said base; and a fixed platform section mounted adjacent said one ends of said side platform sections and above said pivotal mounting means.

2. The work platform according to claim 1 wherein said pivotal mounting means includes a knuckle member pivotally mounted about a first axis on said base, said side platform sections being pivotally mounted on said knuckle member about a second axis transverse to said first axis, and wherein said work platform further includes movement means coupled between said knuckle member and said side platform sections for moving said side platform section about said second axis.

3. The work platform according to claim 2 wherein said movement means comprises hydraulic actuators.

4. The work platform according to claim 2 wherein said fixed platform section is mounted on said knuckle member above said side platform sections.

5. The work platform according to claim 4 wherein said fixed platform section is mounted above said side platform sections to define a step therebetween.

6. The work platform according to claim 4 wherein said fixed platform section and said side platform sections are at least partially surrounded by rails.

7. The work platform according to claim 6 wherein said rails are formed to provide clearance between the rail of said fixed platform section and the rails of said side platform sections for all positions of said side platform sections with respect to said fixed platform section.

8. The work platform according to claim 1 wherein the inner edge of said side platform sections that are proximate to each other when said side platform sections are adjacent one another include cushion means.

9. The work platform according to claim 1 wherein the inner edges of said side platform sections that are proximate to each other when said side platform sections are adjacent one another include a trough.

10. A work platform according to claim 8 wherein said side platform sections include a trough along said inner edges adjacent said cushion means.

11. The work platform according to claim 1 wherein at least one of said side platform sections includes means for selectively covering the inner edges of said side platform sections when said side platform sections are adjacent one another.

12. The work platform according to claim 11 wherein said covering means comprises a flap hinged on one of said side platform sections.

13. The work platform according to claim 10 wherein at least one of said side platform sections includes means for selectively covering the inner edges, cushion means, and troughs of said side platform sections when said side platform sections are adjacent one another.

14. The work platform according to claim 1 including means for preventing relative deflection between said side platform sections when said side platform sections are adjacent one another.

15. The work platform according to claim 14 wherein said relative deflection preventing means comprises an extendable pin on one side platform section insertable in a loop on the other side platform section.

16. The work platform according to claim 12 further including means for preventing relative deflection between said side platform sections when said sections are adjacent one another, said means comprising an extendable pin on one of said side platform sections insertable in a loop on the other of said side platform sections, and wherein said flap includes a tang positionable beneath said pin when extended for retaining said flap in position.

17. The work platform according to claim 1 further including means for sensing when said work platform is proximate to an object and for providing a signal indicative thereof.

18. A work platform suitable for mounting on a base, comprising:

a pair of side platform sections each having one end adjacent said base and its other end extending from said base, said side platform sections being movable toward and away from each other between a first position in which said side platform sections are adjacent one another and a second position in which said side platform sections diverge in a direction away from said one ends;

pivotal mounting means for pivotally mounting said one ends of said side platform sections to said base; and proximity sensing means for sensing when said work platform is proximate to an object and for providing a signal indicative thereof, said proximity sensing means comprising at least one hoop suspended below said work platform for movement responsive to engagement with the object, and a signal means responsive to the movement of said hoop for providing said signal.

19. The work platform according to claim 18 wherein said signal means includes at least a pair of switches operatively associated with said hoop, said switches being oriented at 90° to each other.

20. The work platform according to claim 1 further including a control station.

21. The work platform according to claim 20 further including a pendant control station for said work platform.

22. The work platform according to claim 1 further defined as suitable for use on a base having a boom pivotal in a vertical plane by an actuator, said work platform being mountable on the tip of said boom, said work platform having a master-slave hydraulic actuator leveling means operatively associated therewith in which the master cylinder is coupled in parallel with said boom actuator.

* * * * *